US006981440B2

(12) United States Patent
Hoshi

(10) Patent No.: US 6,981,440 B2
(45) Date of Patent: Jan. 3, 2006

(54) HIGH-SPEED CYLINDER APPARATUS

(76) Inventor: Hideo Hoshi, 19-14, Maru-no-uchi 3-chome, Naka-ku, Nagoya-shi, Aichi-ken (JP)

( * ) Notice: Subject to any disclaimer, the term of this patent is extended or adjusted under 35 U.S.C. 154(b) by 188 days.

(21) Appl. No.: 10/322,641

(22) Filed: Dec. 19, 2002

(65) Prior Publication Data

US 2003/0121411 A1 Jul. 3, 2003

(30) Foreign Application Priority Data

Dec. 27, 2001 (JP) ..... 2001-397068

(51) Int. Cl.
*F01B 15/00* (2006.01)

(52) U.S. Cl. ..... 92/66; 91/167 R; 100/209; 100/269.07

(58) Field of Classification Search ..... 91/169, 91/167 R, 176, 520; 92/66, 117 R, 117 A, 92/151; 100/209, 269.06, 269.07, 269.14
See application file for complete search history.

(56) References Cited

U.S. PATENT DOCUMENTS

| | | | | |
|---|---|---|---|---|
| 277,912 A | * | 5/1883 | Mahon | 100/209 |
| 473,472 A | * | 4/1892 | Parisher | 100/269.07 |
| 4,443,179 A | | 4/1984 | Wohlrab | |
| 4,833,884 A | * | 5/1989 | Seko et al. | 91/520 |
| 4,977,773 A | | 12/1990 | Mito et al. | |

FOREIGN PATENT DOCUMENTS

| | | |
|---|---|---|
| EP | 0 543 177 A1 | 5/1993 |
| EP | 1 155 790 A2 | 11/2001 |
| GB | 2 004 789 A1 | 4/1979 |
| JP | 01-044227 A1 | 2/1989 |
| JP | 03-125004 A1 | 5/1991 |
| JP | 06-215899 A1 | 8/1994 |
| JP | 2002-070806 A1 | 3/2002 |

* cited by examiner

*Primary Examiner*—F. Daniel Lopez
(74) *Attorney, Agent, or Firm*—Rader, Fishman & Grauer PLLC

(57) ABSTRACT

A movable cylinder (20) is provided with an inner cylinder chamber (21) and an outer cylinder chamber (31) which surrounds the inner cylinder chamber. The inner cylinder chamber is provided with an inner piston (22) inserted therein, which is integrally secured to the stationary rods. The inner cylinder chamber is also provided with an inner front inlet (25), an inner rear inlet (26), an inner rear outlet (27) and an inner front outlet (28), for working fluid to move the movable cylinder. The outer cylinder chamber is provided therein with an outer piston (32) having a front operation member (33) which is moved close to or away from the front stationary table and a rear operation member (34) which is moved close to or away from the rear stationary table. The outer cylinder chamber is also provided with an outer rear inlet (35) which is connected to the inner rear outlet and an outer front inlet (36) which is connected to the inner front outlet, for the working fluid to move the outer piston.

1 Claim, 6 Drawing Sheets

HIGH-SPEED CYLINDER APPARATUS

BACKGROUND OF THE INVENTION

1. Field of the Invention

The present invention relates to a high-speed cylinder apparatus and in particular, it relates to a cylinder apparatus in which a piston is reciprocally movable at high speed.

2. Description of the Related Art

In general, in a conventional unidirectional or bi-directional cylinder apparatus, working fluid on a discharge side is returned to a reservoir during the movement of a piston so as to allow smooth movement of the piston. However, if the working fluid on the discharge side is positively reused as working fluid for moving another piston, the pistons are moved synchronously, so that the stroke of the pistons is prolonged. Namely, the moving speed of the pistons as a whole is increased, thus resulting in reduction in time of one cycle (one reciprocal movement) and in enhancement of the productivity.

Moreover, the reuse of the working fluid on the discharge side makes it possible to reduce the amount of working fluid necessary to actuate the conventional cylinder apparatus, thus leading to reduction the capacity of a pump for feeding the working fluid. Consequently, the space for accommodating the apparatus and the energy necessary to actuate the cylinder apparatus can be advantageously reduced.

The inventor of the present invention has conceived an improved high-speed cylinder apparatus in which a movable cylinder having an inner cylinder element and an outer cylinder element is moved is provided and a piston of the outer cylinder element is moved by the working fluid discharged from the inner cylinder element.

SUMMARY OF THE INVENTION

It is an object of the present invention to provide a highly productive cylinder apparatus in which a piston is movable reciprocally in opposite directions at high speed. Another object of the present invention is to provide a highly effective cylinder apparatus in which requires less space for accommodating the same and consumes less energy. To this end, according to the present invention, there is provided a high-speed cylinder apparatus comprising a machine bed (11) which is comprised of a front stationary table (12), a front stationary member (13), a rear stationary member (14) and a rear stationary table (15), arranged in this order, stationary rods (18) which are secured between the front stationary member and the rear stationary member, and a movable cylinder (20) through which the stationary rods extend, said movable cylinder being provided with an inner cylinder chamber (21) and an outer cylinder chamber (31) which surrounds the inner cylinder chamber, said inner cylinder chamber being provided with an inner piston (22) inserted therein, which is integrally secured to the stationary rods, said inner cylinder chamber being provided with an inner front inlet (25), an inner rear inlet (26), an inner rear outlet (27) and an inner front outlet (28), for working fluid to move the movable cylinder, said outer cylinder chamber being provided therein with an outer piston (32) having a front operation member (33) which is moved close to or away from the front stationary table and a rear operation member (34) which is moved close to or away from the rear stationary table, said outer cylinder chamber being provided with an outer rear inlet (35) which is connected to the inner rear outlet and an outer front inlet (36) which is connected to the inner front outlet, for the working fluid to move the outer piston.

BRIEF DESCRIPTION OF THE DRAWINGS

The invention will be discussed below in detail with reference to the accompanying drawings, in which.

DESCRIPTION OF THE PREFERRED EMBODIMENTS

Figure 1:
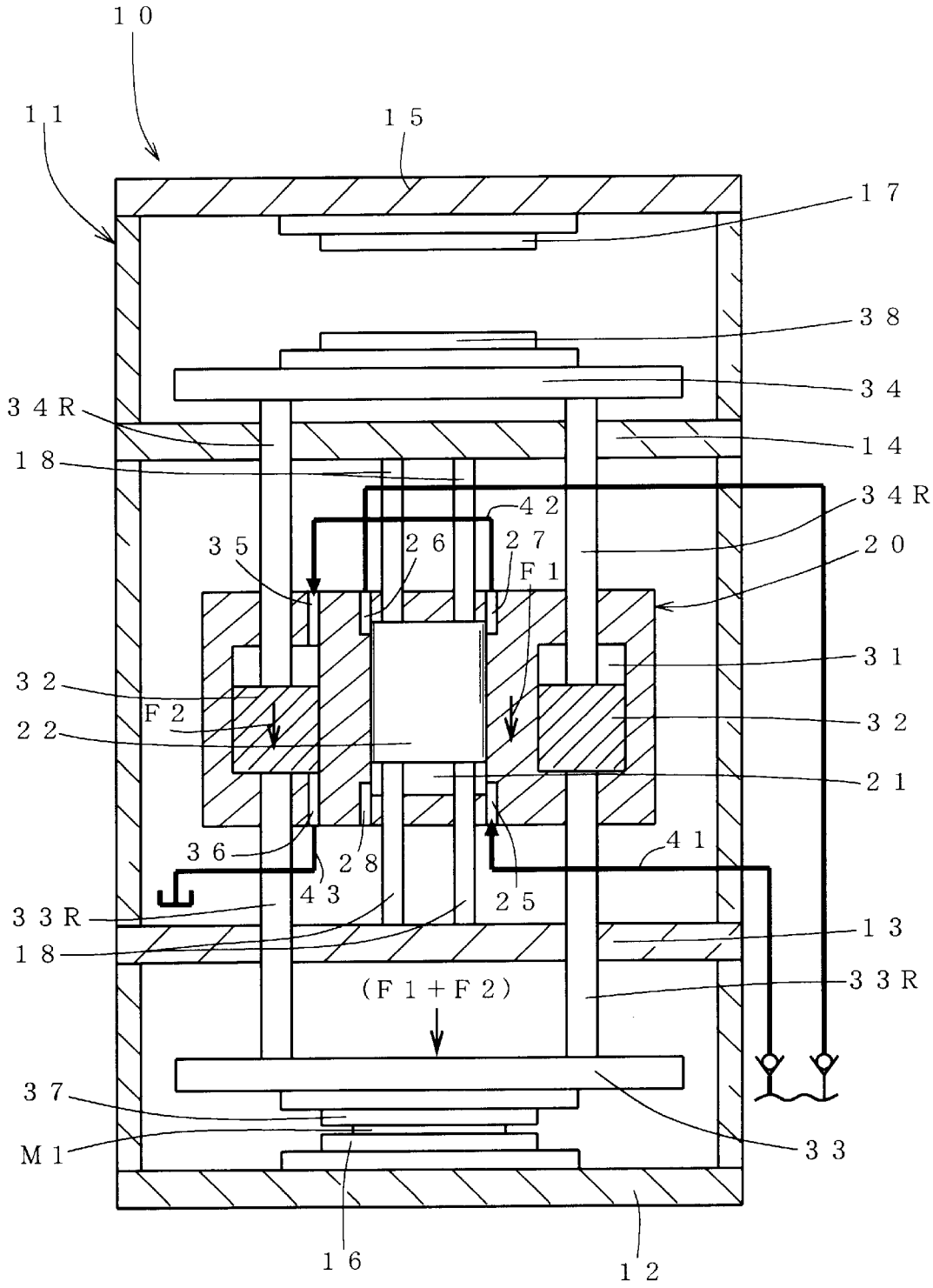
FIG. 1 shows schematically a longitudinal sectional view of a high-speed cylinder apparatus according to an embodiment of the present invention in a forward position.
Figure 2:
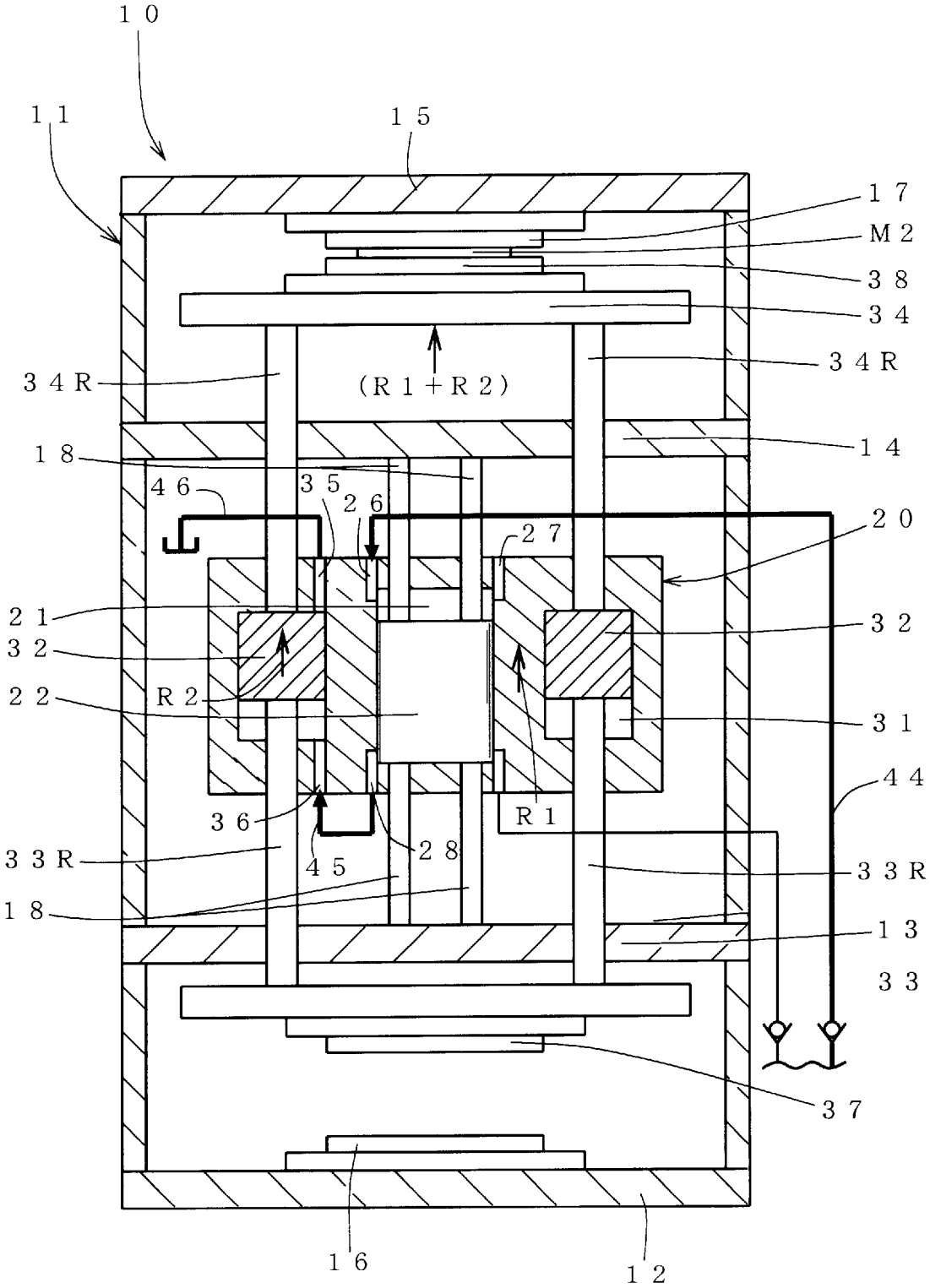
FIG. 2 shows schematically a longitudinal sectional view of a high-speed cylinder apparatus according to an embodiment of the present invention, in a rearward position.

As can be seen in FIGS. 1 and 2, a high-speed cylinder apparatus 10 is comprised of a machine bed 11, stationary rods 18, and a movable cylinder 20. The machine bed 11 is provided thereon with a front stationary table 12, a front stationary member 13, a rear stationary member 14, and a rear stationary table 15, arranged in this order from the front side (bottom side in FIG. 1). The front stationary table 12 and the rear stationary table 15 opposed thereto constitute working stations of the cylinder apparatus 10. In this embodiment, stationary dies 16 and 17 for metal pressing are mounted to the stationary tables 12 and 15, respectively. In the illustrated embodiment, the bottom side in the drawing is referred to as a front side and the upper side is referred to as a rear side. Namely, the cylinder apparatus illustrated is a vertical type. However, the invention is not limited thereto and can be equally applied to a horizontal type cylinder apparatus. The stationary rods 18 extend between the front and stationary members 13 and 14 of the machine bed 11. The stationary rods 18 are provided with an inner piston 22 secured thereto. In general, a plurality of stationary rods 18 (four rods in the illustrated embodiment. See FIG. 3) are provided.

Figure 3:
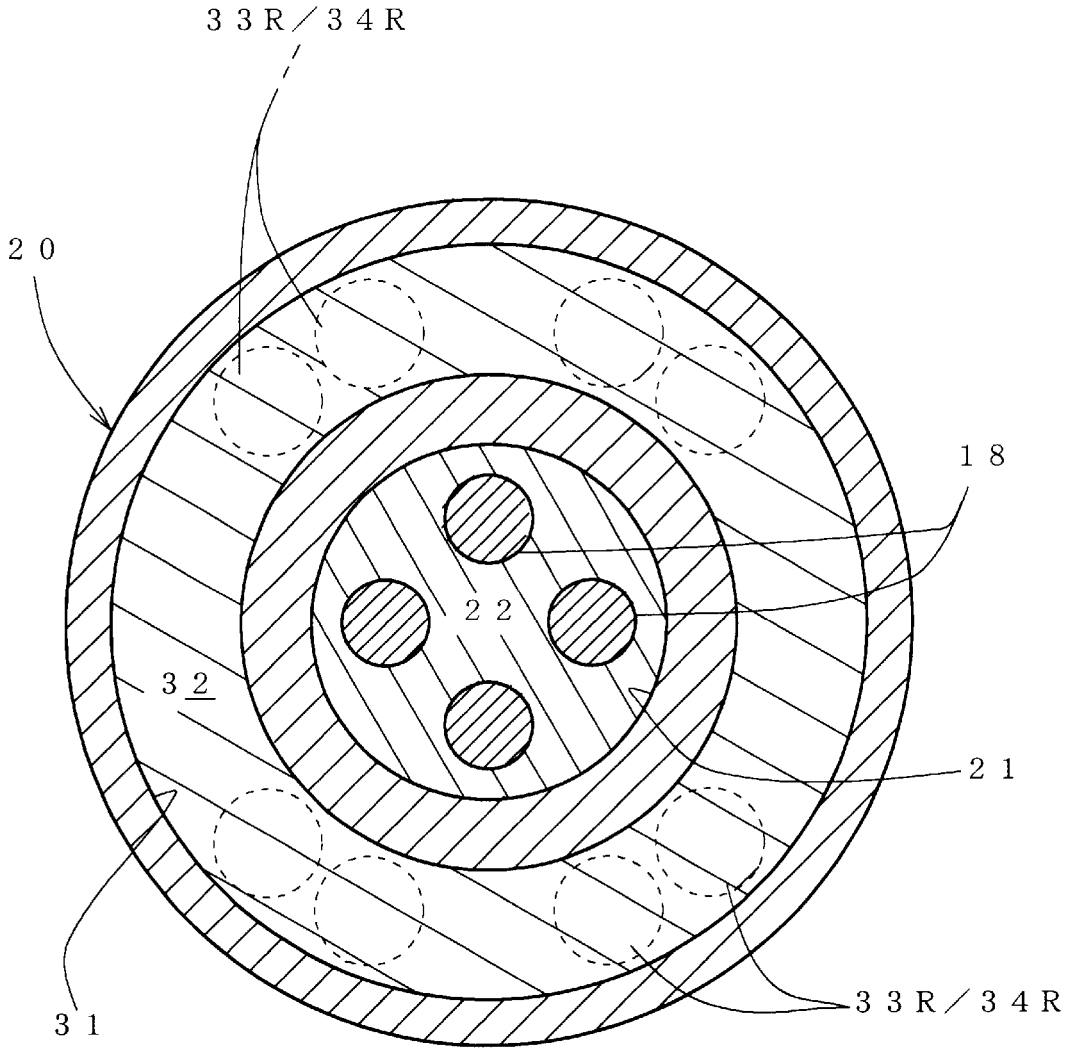
FIG. 3 shows a cross sectional view of a movable cylinder.

The movable cylinder 20 is provided with an inner cylinder chamber 21 and an outer cylinder chamber 31 surrounding the inner cylinder chamber 21, as shown in FIG. 3. The inner piston 22 secured to the stationary rods 18 is inserted in the inner cylinder chamber 21. The inner cylinder chamber 21 is provided with an inner front inlet 25, an inner rear inlet 26, an inner rear outlet 27 and an inner front outlet 28, for the working fluid (pressurized oil in this embodiment) to move the movable cylinder 20.

In the outer cylinder chamber 31 is inserted a front piston 32 which is integrally provided with a front operation member 33 which is moved with respect to the front stationary table 12 of the machine bed 11 and a rear operation member 34 which is moved with respect to the rear stationary table 15. In the drawings, numerals 33R and 34R designate the rod portions of the front operation member 33 and the rear operation member 34, respectively. The outer cylinder chamber 31 is provided with an outer rear inlet 35 connected to the inner rear outlet 27 for the working fluid to move the outer piston 32 and an outer inlet 36 connected to the inner outlet 28.

Figure 4:
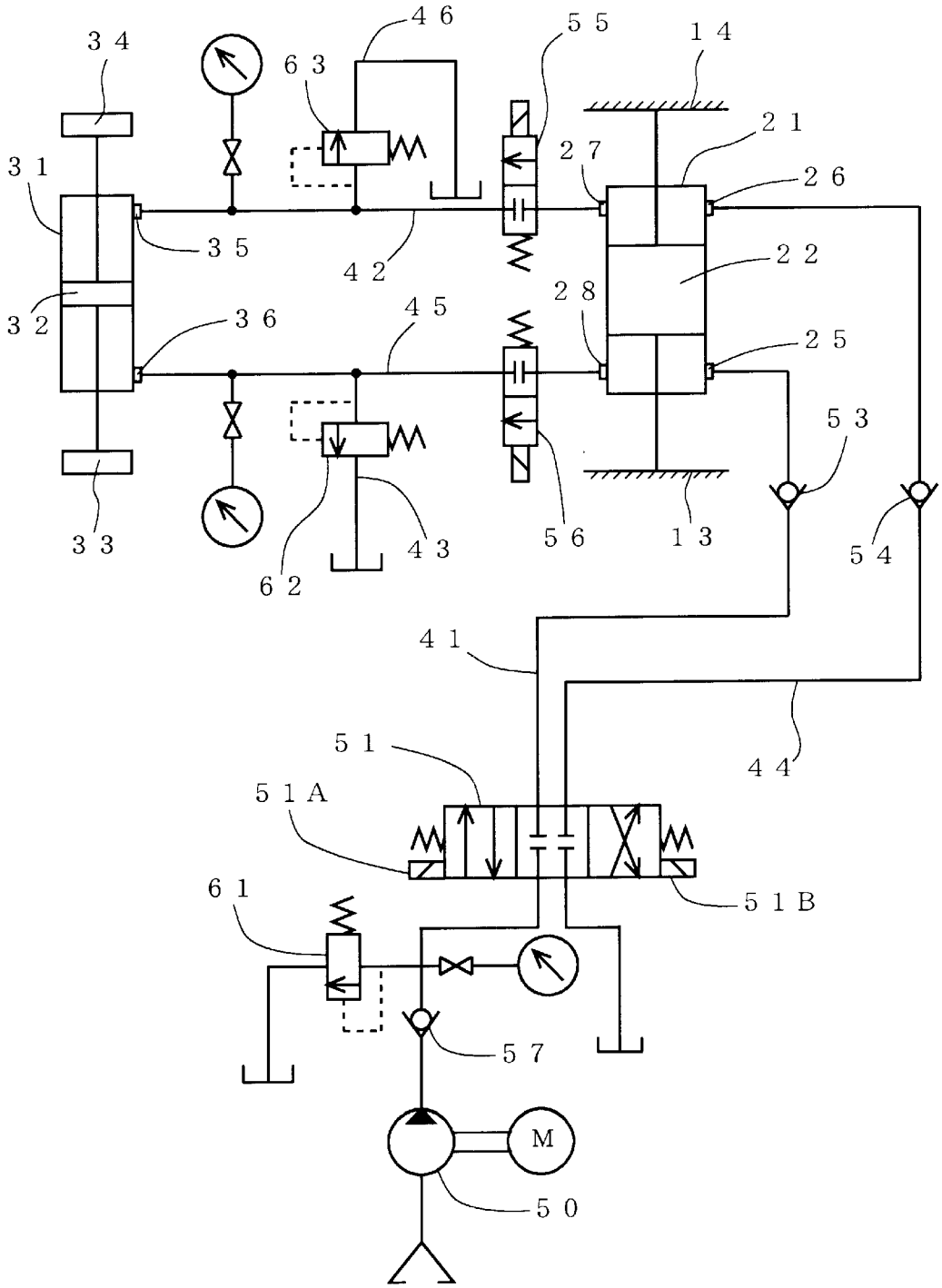
FIG. 4 shows a hydraulic circuit diagram for actuating a cylinder apparatus shown in FIGS. 1 and 2.

Although no independent outlet for the working fluid is provided in the outer cylinder chamber 31 in the illustrated embodiment, the outer rear inlet 35 and the outer front inlet 36 serve as outlets due to switching valves 55 and 56 provided therein, as can be seen in the hydraulic circuit diagram shown in FIG. 4. As a matter of course, independent outlets may be provided.

The high-speed cylinder apparatus 10 of the present invention operates as follows.

FIG. 4 shows a hydraulic circuit diagram for actuating the cylinder apparatus 10, according to the embodiment. Note that the working fluid is not limited to pressurized oil. Numerals 41, 42 and 43 designate the advancing circuit and numerals 44, 45 and 46 designate the retracting circuit. In FIG. 4, numeral 50 designates the pump, 51 the switching valve, 51A the advancing switch thereof, 51B the retracting switch, 53, 54 and 57 the check valves, 55 the (advancing) switching valve, 56 the (retracting) switching valve, and 61, 62 and 63 the unloaders.

The advance movement shown in FIG. 1 is discussed below. To this end, the advancing circuits 41, 42 and 43 in the circuit diagram in FIG. 4 are in an operative position. Namely, the advancing switch 51A of the switching valve 51 is turned ON, the switching valve (for the advance movement) 55 it turned ON, and the switching valve (for the retracting movement) 56 is turned OFF. The pressurized oil fed from the pump 50 is introduced to the front portion of the inner cylinder chamber 21 from the inner front inlet 25 of the movable cylinder 20, through the circuit 41. The inner piston 22 inserted in the inner cylinder chamber 21 is secured to the stationary rods 18 and the opposing ends of the stationary rods 18 are secured to the front stationary member 13 and the rear stationary member 14, respectively. Therefore, when the pressurized oil is introduced into the front portion of the inner cylinder chamber 21, the movable cylinder 20 is moved forward in the direction indicated by an arrow F1 in FIG. 1.

The forward movement of the movable cylinder 20 in the direction F1 causes the pressurized oil in rear of the inner piston 22 to move from the inner rear outlet 27 into the outer rear inlet 35 of the outer cylinder chamber 31 of the movable cylinder 20 through the circuit 42 in which the switching valve 55 is turned ON. Consequently, the outer piston 32 is advanced in the direction F2 in FIG. 1. The pressurized oil in front of the outer piston 32 in the outer cylinder chamber 31 is discharged outside from the outer front inlet (which serves as an outlet in this case) 36 in accordance with the advance movement of the outer piston 32. As the switching valve 56 is OFF, the pressurized oil is returned from the circuit 43 to the reservoir through the unloader 62.

The backward movement (retracting movement) shown in FIG. 2 will be discussed below.

The retracting switch 51B is ON, the switching valve (for the advancing movement) 55 is OFF, and the switching valve (for the retracting movement) 56 is ON, so that the retracting circuits 44, 45 and 46 are in an operative position. Namely, the pressurized oil from the pump 50 is introduced into the rear portion of the inner cylinder chamber 21 from the inner rear inlet 26 of the movable cylinder 20 through the circuit 44 when the retracting switch 51B of the switching valve 51 is ON. The inner piston 22 inserted in the inner cylinder chamber 21 is integrally connected to the stationary rods 18 whose ends are integrally connected to the front and rear stationary members 13 and 14, as mentioned above. Therefore, if the pressurized oil is introduced in the rear portion of the inner cylinder chamber 21, the movable cylinder 20 itself is moved backward in the direction R1 in FIG. 2.

In accordance with the backward movement of the movable cylinder 20 in the direction R1, the pressurized oil in front of the inner piston 22 is moved from the inner front inlet 28 into the outer front inlet 36 of the outer cylinder chamber 31 of the movable cylinder 20 through the circuit 45 in which the switching valve 56 is ON. Consequently, the outer piston 32 is retracted in the direction R2 in FIG. 2.

The backward movement of the outer piston 32 causes the pressurized oil in the rear portion of the outer piston 32 within the outer cylinder chamber 31 to be discharged outside from the outer rear inlet (which serves as an inlet in this case) 35. As the switching valve 55 is OFF, the pressurized oil is returned from the circuit 46 to the reservoir through the unloader circuit 63.

As can be understood from the foregoing, in a high-speed cylinder apparatus 10 of the present invention, the sum (F1+F2) of the forward displacement F1 of the movable cylinder 20 caused by the inner cylinder chamber 21 and the forward displacement F2 of the outer piston 32 in the outer cylinder chamber 31 is identical to the forward displacement of the front operation member 33 with respect to the front stationary table 12. Consequently, the workpiece M1 is pressed by the movable die 37 provided on the front operation member 33 and the stationary die 16 of the front stationary table 12 (FIG. 1).

Upon backward movement (retracting movement), the sum (R1+R2) of the rearward displacement R1 of the movable cylinder 20 caused by the inner cylinder chamber 21 and the rearward displacement R2 of the outer piston 32 in the outer cylinder chamber 31 is identical to the backward displacement of the rear operation member 34 with respect to the rear stationary table 15. Consequently, the workpiece M2 is pressed by the movable die 38 provided on the rear operation member 34 and the stationary die 17 of the rear stationary table 15 (FIG. 2).

Figure 5:
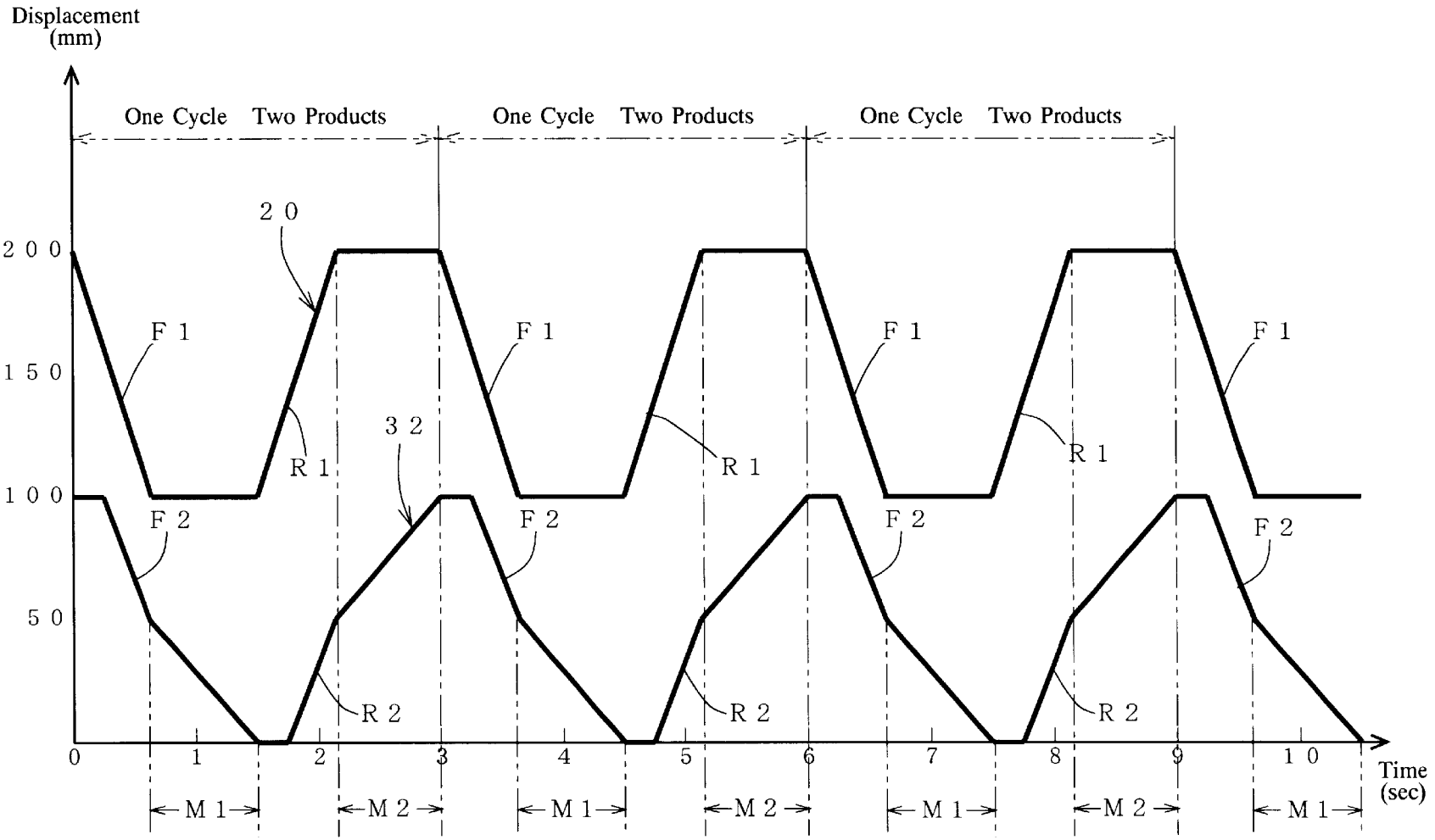
FIG. 5 shows a graph showing a relationship between the displacements of a movable cylinder and an outer piston and time; and, FIG. 6 is a graph showing a relationship between the displacement of a piston and time in a known cylinder apparatus.

FIG. 5 shows the displacements of the movable cylinder 20 and the outer piston 32 in connection with time. In this embodiment, the velocity of the forward or backward movement by the pistons is 150 mm/sec. and that at the pressing operation is 50 mm/sec.

As may be seen from the drawings, the forward movement F2 of the outer piston 32 begins slightly behind the forward movement F1 of the movable cylinder 20, and thereafter, the workpiece M1 is subject to press machining under pressure at the low speed. While the workpiece M1 is pressed, no movement of the movable cylinder 20 occurs, and in this period of time, the supply of the pressurized oil to the inner cylinder chamber 21 is switched. As soon as the pressing of the workpiece M1 is completed, the pressurized oil is fed to the inner cylinder chamber 21 for the rearward movement, so that the movable cylinder 20 begins the rearward movement R1. In accordance with the rearward movement of the movable cylinder 20, the hydraulic circuit of the pressurized oil in the outer cylinder chamber 31 is switched. Consequently, the outer piston 32 begins the rearward movement R2 in retard of the rearward movement R1 of the movable cylinder 20 and thereafter, the workpiece M2 is subject to press machining under pressure at the low speed. Thus, one cycle is completed and the workpieces M1 and M2 are pressed.

While the workpiece M2 is subject to a pressing operation, the movable cylinder 20 does not move. During this period of time, the hydraulic circuit to supply the pressurized oil to the inner cylinder chamber 21 is switched, so that as soon as the pressing of the workpiece M2 is completed, the pressurized oil is supplied to the inner cylinder chamber 21 for the forward movement. Consequently, the movable cylinder 20 begins the forward movement F1.

As can be seen from the above discussion, in the high-speed cylinder apparatus 10 of the present invention, as the switching operation of the hydraulic circuit to supply the working fluid to the inner cylinder chamber 21 and the outer cylinder chamber for the forward movement or rearward movement can be effectively carried out during the movement of the outer piston 33 or movement of the movable cylinder 20, the operation time can be remarkably reduced. Note that in the illustrated embodiment, two workpieces M1 and M2 can be produced in one cycle of 3 seconds.

Figure 6:
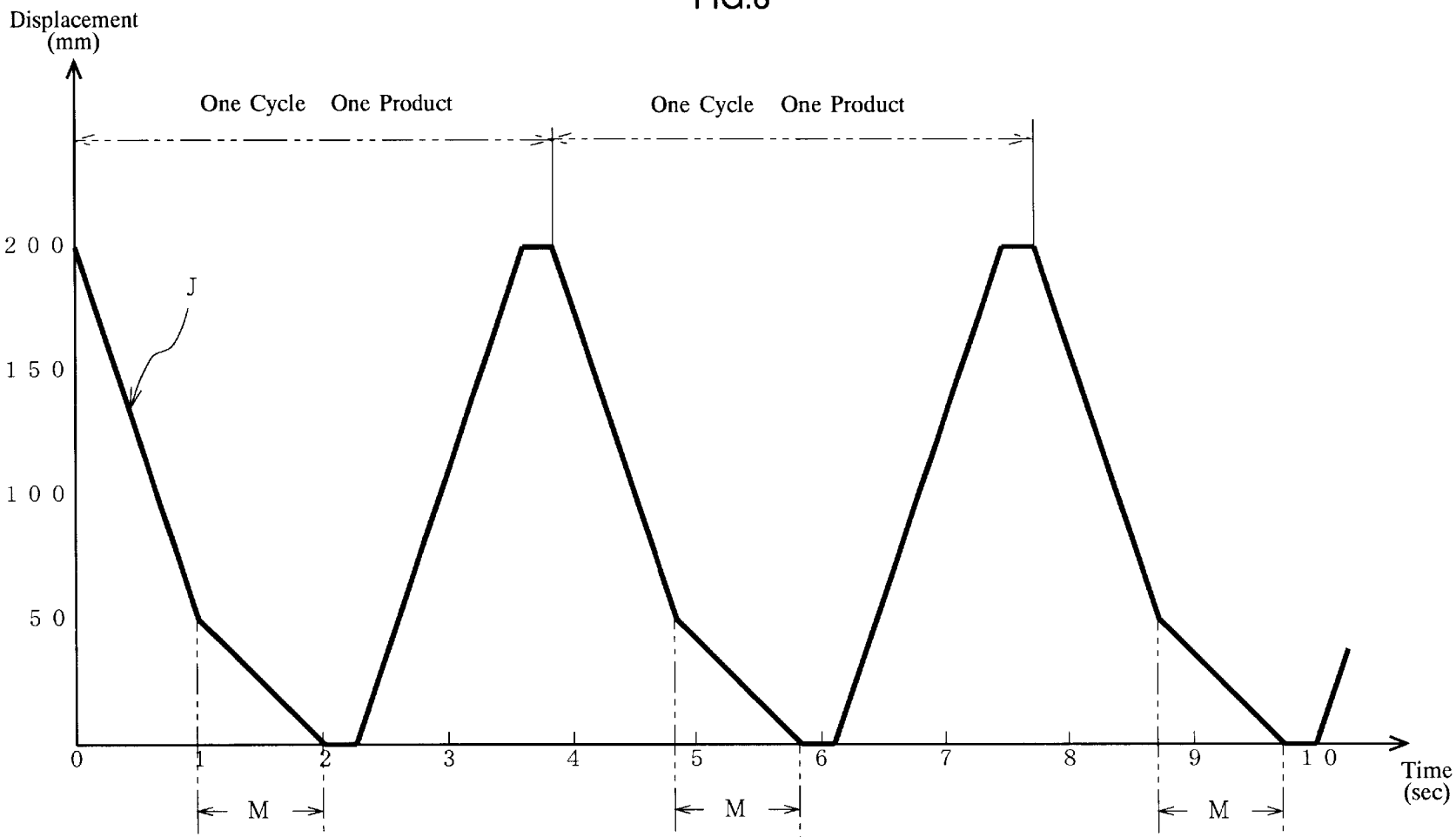
Prior Art FIG.6

FIG. 6 is a graph corresponding to FIG. 5, showing a known cylinder apparatus in which the pressing operation is carried out under the same conditions as those of the present invention. The velocity of the forward or rearward movement by the pistons in the known cylinder apparatus J is 150 mm/sec and that at the pressing operation is 50 mm/sec., as in the present invention. However, as can be seen from FIG. 6, the velocity of the forward or rearward movement in a known apparatus is identical to that determined by a single piston. Moreover, it takes time (approximately ¼ sec.) to switch the forward and rearward movements. In the known apparatus, it takes approximately 4 seconds to machine one workpiece M. In comparison with the present invention in which two workpieces M1 and M2 can be machined in one cycle of 3 seconds, the prior art requires time of more than 2.6 times the present invention.

As may be understood from the above discussion, in a high-speed cylinder apparatus according to the present invention, when the movable cylinder is advanced, the outer piston is independently advanced in association therewith, and when the movable cylinder is retracted, the outer piston is retracted in association therewith. Therefore, the operation member provided on the outer piston can be moved by a displacement identical to the sum of the displacement of the movable cylinder and the displacement of outer piston within the substantially same time and hence, operation member can be moved at high-speed within a short space of time, in comparison with the case in which the same displacement is produced by the single piston.

Moreover, in a high-speed cylinder apparatus of the present invention, the operation members are moved in opposite directions, the productivity can be enhanced.

Furthermore, in the present invention, the movable cylinder is moved by the inner piston secured to the stationary rods which are in turn secured to and between the front and rear stationary members, and the front and rear operation members are provided on the outer piston. Therefore, the operation members can provide a large space between the same and the corresponding stationary tables, as in a common cylinder apparatus. The large space makes it possible to easily load or unload the workpieces or to easily replace the press dies.

Furthermore, according to the present invention, not only can the accommodation space of the apparatus be saved but also the energy consumption can be reduced. Thus, a high speed cylinder apparatus which is practically very advantageous can be provided, according to the present invention.

What is claimed is:

1. A high-speed cylinder apparatus comprising a machine bed(11) which is comprised of a front stationary table(12), a front stationary member (13), a rear stationary member (14) and a rear stationary table (15), arranged in this order, stationary rods (18) which are secured between the front stationary member and the rear stationary member, and a movable cylinder (20) through which the stationary rods extend, said movable cylinder being provided with an inner cylinder chamber (21) and an outer cylinder chamber (31) which surrounds the inner cylinder chamber, said inner cylinder chamber being provided with an inner piston (22) inserted therein, which is integrally secured to the stationary rods, said inner cylinder chamber being provided with an inner front inlet (25), an inner rear inlet (26), an inner rear outlet (27) and an inner front outlet (28), for working fluid to move the movable cylinder, said outer cylinder chamber being provided therein with an outer piston (32) having a front operation member (33) which is moved close to or away from the front stationary table and a rear operation member (34) which is moved close to or away from the rear stationary table, said outer cylinder chamber being provided with an outer rear inlet (35) which is connected to the inner rear outlet and an outer front inlet (36) which is connected to the inner front outlet, for the working fluid to move the outer piston.

* * * * *